US008733297B2

(12) United States Patent
Tsuji et al.

(10) Patent No.: US 8,733,297 B2
(45) Date of Patent: May 27, 2014

(54) WATER HEATER

(75) Inventors: Yoshikatsu Tsuji, Sapporo (JP); Atsushi Yamane, Sapporo (JP)

(73) Assignee: Paloma Co., Ltd., Nagoya (JP)

( * ) Notice: Subject to any disclaimer, the term of this patent is extended or adjusted under 35 U.S.C. 154(b) by 771 days.

(21) Appl. No.: 12/482,662

(22) Filed: Jun. 11, 2009

(65) Prior Publication Data

US 2010/0116222 A1 May 13, 2010

(30) Foreign Application Priority Data

Nov. 11, 2008 (JP) ..... 2008-289149

(51) Int. Cl.
*F24H 1/10* (2006.01)

(52) U.S. Cl.
USPC ..... 122/14.3; 122/14.2

(58) Field of Classification Search
USPC ..... 122/14.2, 14.21, 14.3; 236/18
See application file for complete search history.

(56) References Cited

U.S. PATENT DOCUMENTS

| | | | | |
|---|---|---|---|---|
| 4,501,261 | A * | 2/1985 | Tsutsui et al. | 122/14.3 |
| 5,058,804 | A * | 10/1991 | Yonekubo et al. | 236/12.12 |
| 6,596,159 | B1 * | 7/2003 | Maruyama et al. | 210/139 |
| 2010/0116223 | A1 * | 5/2010 | Tsuji et al. | 122/14.3 |

FOREIGN PATENT DOCUMENTS

| | | | |
|---|---|---|---|
| JP | 61-015447 | U | 1/1986 |
| JP | 01-150741 | A1 | 6/1989 |
| JP | 01-302063 | AI | 12/1989 |
| JP | 06-002943 | A1 | 1/1994 |
| JP | 07-243700 | A1 | 9/1995 |
| JP | 09-184658 | A1 | 7/1997 |
| JP | 09-318153 | A1 | 12/1997 |
| JP | 2000-199647 | A1 | 7/2000 |
| JP | 2008-057845 | A1 | 3/2008 |

OTHER PUBLICATIONS

Japanese Office Action dated Aug. 16, 2012.

* cited by examiner

*Primary Examiner* — Kang Hu
*Assistant Examiner* — John Bargero
(74) *Attorney, Agent, or Firm* — Burr & Brown, PLLC

(57) ABSTRACT

At the time of starting a hot water discharge operation, a controller determines whether the first operation was made after the power source is switched on in S1, and the controller determines whether 5 minutes have passed after the previous operation in S2. When the first operation was not made or 5 minutes have lapsed after the last operation, the controller determines whether a difference between a detected temperature acquired by a thermistor and a preset temperature is more than 10° C. in S3. When a temperature difference is more than 10° C., a water flow rate servo is set at a position where a flow rate of flowing water is reduced from a determined flow rate by a predetermined amount in S4, and the controller performs a temperature control of discharged hot water in S8.

4 Claims, 6 Drawing Sheets

WATER HEATER

BACKGROUND OF THE INVENTION

This application claims the benefit of Japanese Patent Application Numbers 2008-289149 which were filed on Nov. 11, 2008, the entirety of which is incorporated by reference.

FIELD OF THE INVENTION

The present invention relates to a water heater having a water flow rate control unit for controlling a flow rate of flowing water in a heat exchanger.

DESCRIPTION OF THE BACKGROUND ART

In a water heater, a water supplying pipe and a hot-water discharging pipe are connected with a heat exchanger heated by a burner. When a faucet is opened and water is passed into the device, a controller (an operation control unit) detects passing water and operates the burner to heat the water passing through the heat exchanger. Then, the heated water is discharged from the hot-water discharging pipe. Japanese Unexamined Patent Publication No. 2008-57845 discloses a water heater including a water flow rate control unit such as a water flow rate servo or the like at the water supplying pipe. The water flow rate control unit controls a flow rate of flowing water in the heat exchanger. In this water heater, the controller controls a temperature of discharged hot water so as to make a detected temperature of discharged hot water (a temperature of discharged hot water) to be equal to a preset temperature, by control of combustion of the burner and an operation of the water flow rate control unit,. The detected temperature of discharged hot water is acquired by a temperature detection unit, such as a thermistor or the like, provided at the hot-water discharging pipe.

SUMMARY OF THE INVENTION

However, in a conventional water heater, as described above, a flow rate of flowing water controlled by the water flow rate control unit is set to be as a pre-determined flow rate at a time of starting of an operation. Thus, in the case where a temperature of flowing water is low, or so-called cold start where an operation of the water heater is started by switching on a power source at a first time after installing the device or is started when a long time elapses after the last hot water supplying, it takes a long time for the temperature of discharged hot water to reach a preset temperature and consumptions of water and fuel gas during that time become high, which leads to loss.

The present invention is to provide a water heater capable of shortening a time required to reach the preset temperature even at a time of the cold start, and thus saving water and gas.

According to a first aspect of the present invention, an operation control unit compares a detected temperature acquired by a temperature detection unit with a preset temperature at the time of starting of an operation, (e.g., water discharge), and when the detected temperature is lower than the preset temperature by a predetermined degree, the operation control unit makes a water flow rate control unit have a flow rate of flowing water reduced (e.g., through the heat exchanger) to less than a previously determined flow rate of flowing water, and performs a temperature control of discharged hot water.

According to a second aspect of the present invention, in order to operate a temperature control of normal discharged hot water with a sufficient flow rate of flowing water even though the flow rate of flowing water is reduced at the time of starting of the operation in the first aspect, the operation control unit sets back the flow rate of flowing water of the water flow rate control unit to the determined flow rate when the detected temperature approximately agrees with the preset temperature in the temperature control of discharged hot water.

Here, the phrase "the detected temperature approximately agrees with the preset temperature" includes a case where the detected temperature agrees with the present temperature, and also includes a case where the detected temperature is slightly higher or lower than the preset temperature.

According to a third aspect of the present invention, in order to operate the temperature control of normal discharged hot water with a sufficient flow rate of flowing water even though the flow rate of flowing water is reduced at the time of starting of the operation in the first aspect, the operation control unit sets back the flow rate of flowing water of the water flow rate control unit to the determined flow rate when a predetermined time elapses after starting of the operation.

According to the first aspect of the present invention, when a water temperature in the water heater is low, the temperature control of discharged hot water at a time of starting of the operation is performed with the reduced flow rate of flowing water. Thus, even in the case of the cold start is made, a time required to reach the preset temperature can be shortened, thereby resulting in saving water and gas.

According to the second and third aspects of the present invention, in addition to the effect of the first aspect, a temperature control of normal discharged hot water can be performed with a sufficient flow rate of flowing water.

BRIEF DESCRIPTION OF THE DRAWINGS

FIG. 3 is a graph illustrating changes of a position of a water flow rate servo and a flow rate of flowing water at a time of starting of an operation at a preset temperature of 60° C., wherein

FIG. 4 is a graph illustrating changes of a position of the water flow rate servo and a flow rate of flowing water at a time of starting of an operation at a preset temperature of 38° C., wherein

DETAILED DESCRIPTION OF THE INVENTION

Embodiments of the present invention will be described below referring to drawings.

Figure 1:
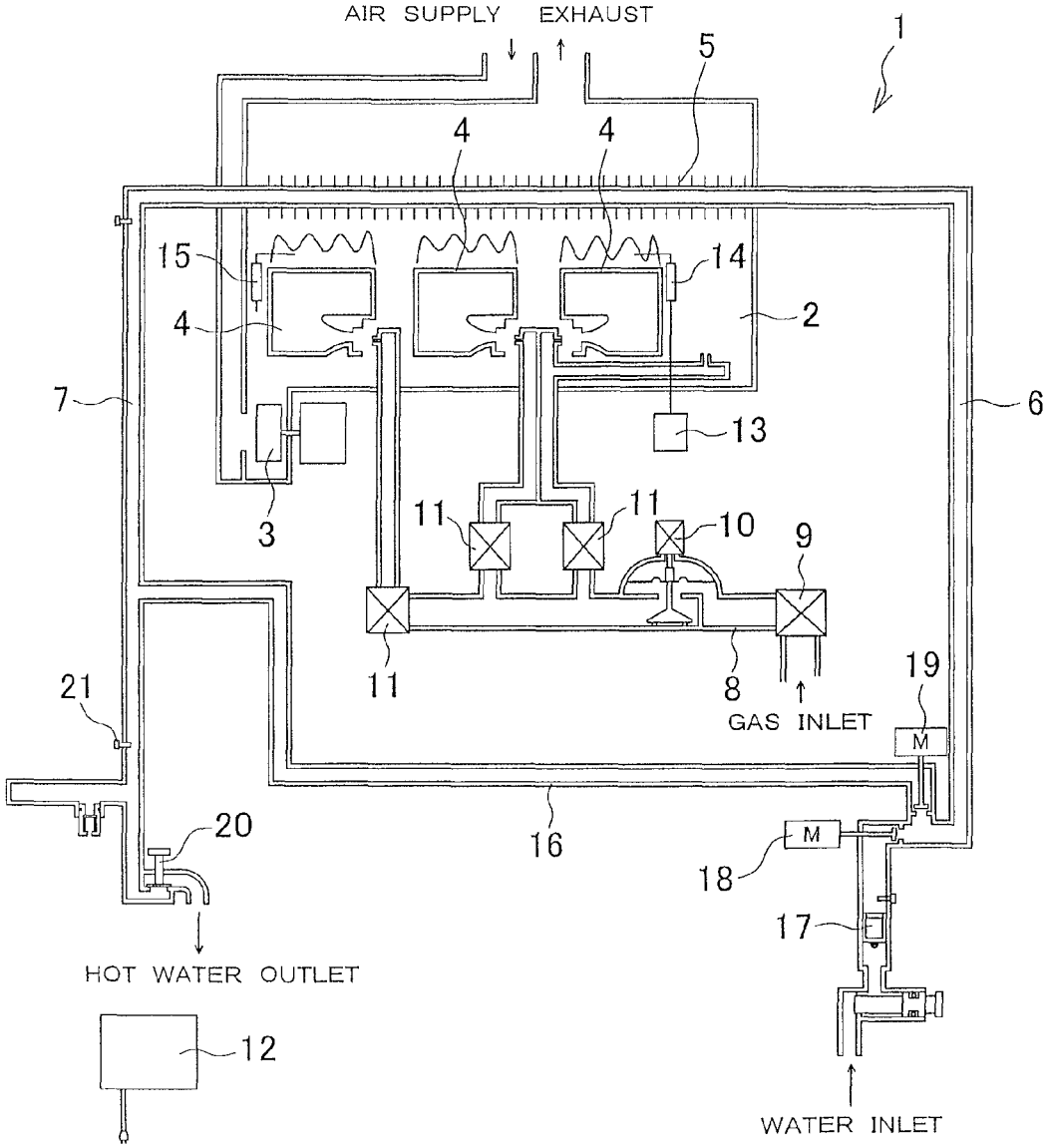
FIG. 1 is a schematic view of a water heater.

FIG. 1 is a schematic view for illustrating one example of a water heater. A water heater 1 includes a combustion chamber 2 having an air supply fan 3 in a water heater main body. The combustion chamber 2 is provided with, in its inside, a plurality of burners 4, 4, . . . (3 units in this case) for combusting mixed gas of fuel gas and primary air from the air supply fan 3, and a heat exchanger 5 heated by combustion of the burner 4, the heat exchanger 5 being connected with a water supplying pipe 6 and a hot-water discharging pipe 7. A main solenoid valve 9 and a gas proportional valve 10 are provided to a gas pipe 8 connected to the burner 4, and changeover solenoid valves 11, 11, . . . are provided in each branch pipe branched from the gas pipe 8 and connected to each burner 4. Each valve can be controlled by a controller 12 serving as an operation control unit. The water heater 1 also includes an igniter 13, an ignition electrode 14, and a frame rod 15.

Further, a bypass pipe 16 for bypassing the heat exchanger 5 is connected between the water supplying pipe 6 and the hot-water discharging pipe 7. A water flow rate sensor 17 for detecting an amount of water flowing in the water supplying pipe 6 and a water flow rate servo 18 as a water flow rate control units are provided upstream of a position connected with the bypass pipe 16 in the water supplying pipe 6. A bypass servo 19 for controlling the amount of water flowing to the bypass pipe 16 is provided at the position connected with the bypass pipe 16. The water flow rate sensor 17, the water flow rate servo 18, and the bypass servo 19 are electrically connected with the controller 12, respectively. On the other hand, a hot water faucet 20 and a thermistor 21 are provided in the hot-water discharging pipe 7. The thermistor 21 is a temperature detection unit for detecting a temperature of hot water in the hot-water discharging pipe 7. The hot water faucet 20 and the thermistor 21 are electrically connected with the controller 12.

Figure 2:
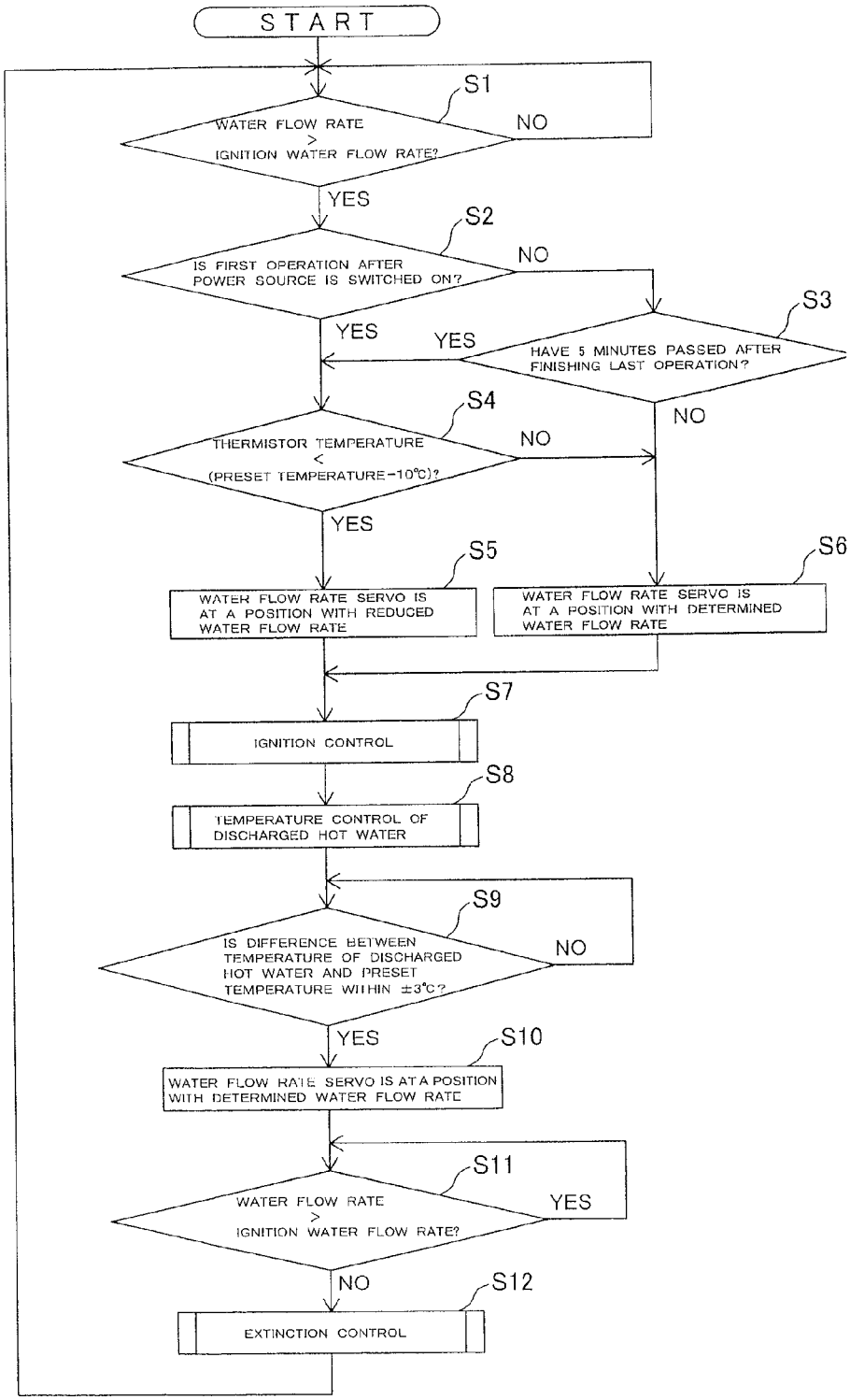
FIG. 2 is a flowchart of an operation control of a water heater.

The operation of the water heater 1 having the aforementioned configuration will be described referring to a flowchart in FIG. 2.

When water is passed through in the water heater 1 by opening the hot water faucet 20 and a flow rate of flowing water in the water heater 1 is confirmed to exceed an ignition water flow rate by means of a signal acquired by the water flow rate sensor 17 in S1, the controller 12 determines whether a first operation was already made after a power source being switched on in S2. If the first operation was made, then, the controller 12 determines whether 5 minutes have passed after completion of the last combustion in S3. If the first operation was not made or 5 minutes have lapsed after the last operation, the controller 12 determines in S4 whether a difference between a detected temperature acquired by the thermistor 21 (temperature of discharged hot water) and a preset temperature set by a remote controller (not shown) is more than 10° C. If the temperature difference is more than 10° C., the water flow rate servo 18 is set at a position where a flow rate of flowing water (through the heat exchanger) is reduced by a predetermined amount from a previously determined flow rate (e.g., 63% of the determined water flow rate) in S5. If the temperature difference is not more than 10° C., the water flow rate servo 18 is set at a position where a flow rate of flowing water is previously determined in S6. It should be noted even when it is determined in S3 that the operation is performed before a lapse of 5 minutes, the water flow rate servo 18 is set at the position of the determined flow rate of flowing water in S5.

Then, the controller 12 rotates the air supply fan 3 so as to carry out pre-purge, opens the main solenoid valve 9, the changeover solenoid valve 11, and the gas proportional valve 10 respectively, supplies gas to the burner 4, and operates an igniter 13 to control ignition of the burner 4, in S7. After confirming ignition of the burner 4 by the frame rod 15, the controller 12 performs a temperature control of discharged hot water in S8, in which a gas amount is continuously changed by control of an opening of the gas proportional valve 10 according to a difference between a temperature of discharged hot water detected by the thermistor 21 and a preset temperature set by the remote controller, so that the temperature of discharged hot water agrees with the preset temperature.

When the difference between the temperature of discharged hot water and the preset temperature becomes within ±3° C. in the determination in S9, the controller 12 sets back the water flow rate servo 18 to the position of the determined flow rate of flowing water in S10 and continues the temperature control of discharged hot water. At this time, the controller 12 changes the rotation rate of the air supply fan 3 depending on a change of the gas amount controlled by the gas proportional valve 10, and controls the ratio of a gas amount and an air amount. When it is confirmed that the flow rate of flowing water is less than the ignition water flow rate due to close of the hot water faucet 20 in S11, the controller 12 closes the main solenoid valve 9, the changeover solenoid valve 11, and the gas proportional valve 10 to extinguish the burner 4, rotates the air supply fan 3 for a certain period of time to carry out a post-purge operation in S12. Then, the operation of the water heater 1 is set back to S1.

Figure 3B:
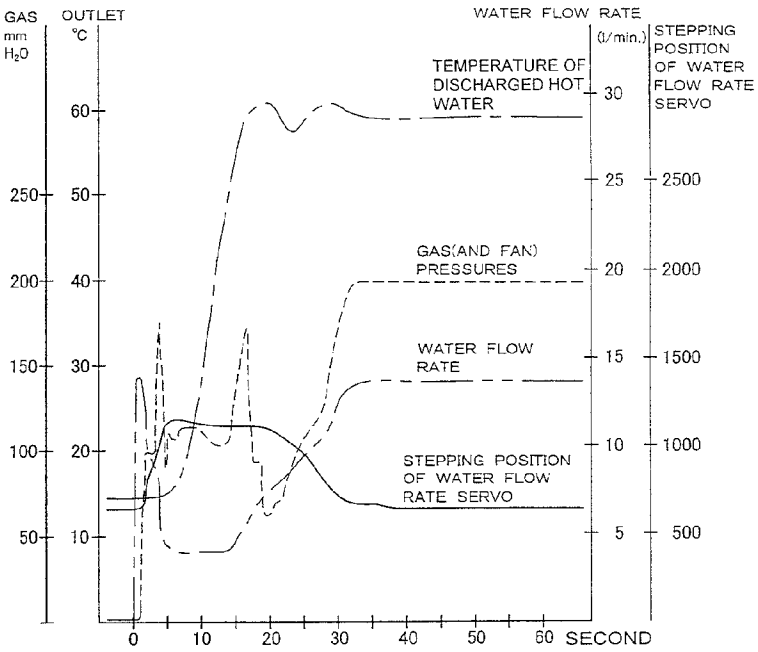
FIG. 3B illustrates a case where an amount of flowing water is 0.29 times.
Figure 3A:
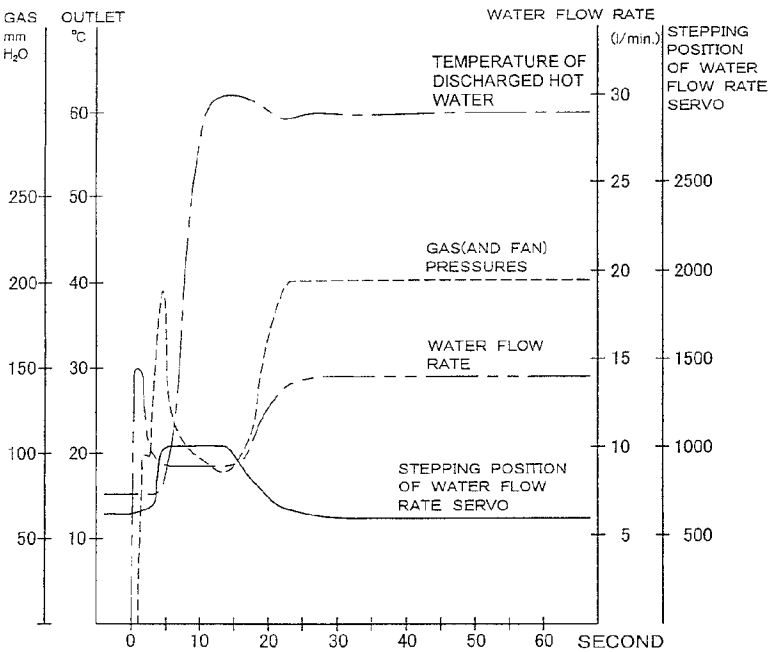
FIG. 3A illustrates a case where an amount of flowing water is 0.63 times.
Figure 4B:
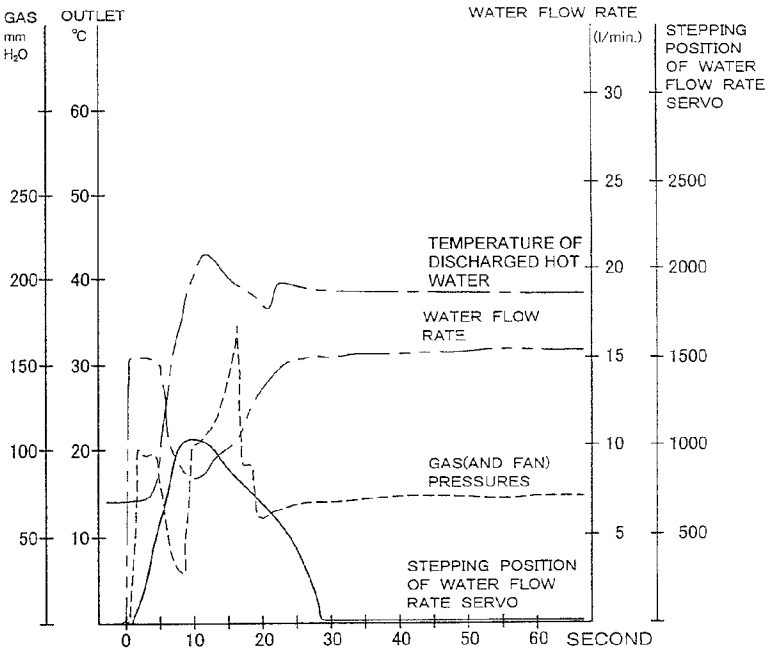
FIG. 4B illustrates a case where an amount of flowing water is 0.29 times.
Figure 4A:
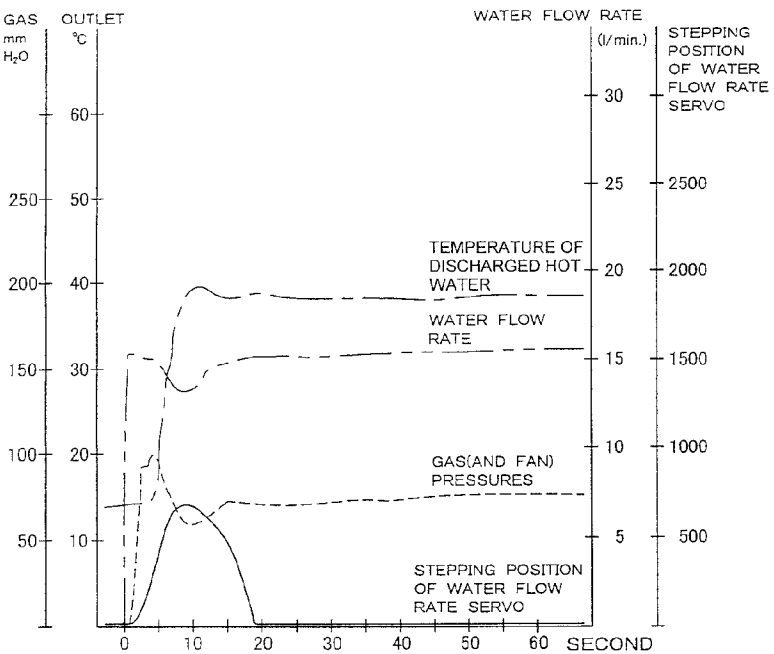
FIG. 4A illustrates a case where an amount of flowing water is 0.63 times.

FIGS. 3 and 4 are graphs illustrating the changes of a stepping position of the water flow rate servo 18 (illustrated with a straight line and the opening becomes narrower as the position becomes larger), water flow rate (illustrated with a two-dotted chain line), gas and air supply fan pressures (illustrated with dotted lines), and a temperature of discharged hot water (illustrated with a one-dot chain line) at a time of ignition control. The preset temperature is 60° C. in FIG. 3 and 38° C. in FIG. 4. FIGS. 3A and 4A indicate cases that an amount of flowing water is 0.63 times of a determined amount, and FIGS. 3B and 4B indicate cases that an amount of flowing water is 0.29 times of the determined amount. A temperature of supplied water is 16° C. Similarly, FIG. 5 is a graph illustrating the changes in the conventional device at a preset temperature of 60° C.

Figure 5:
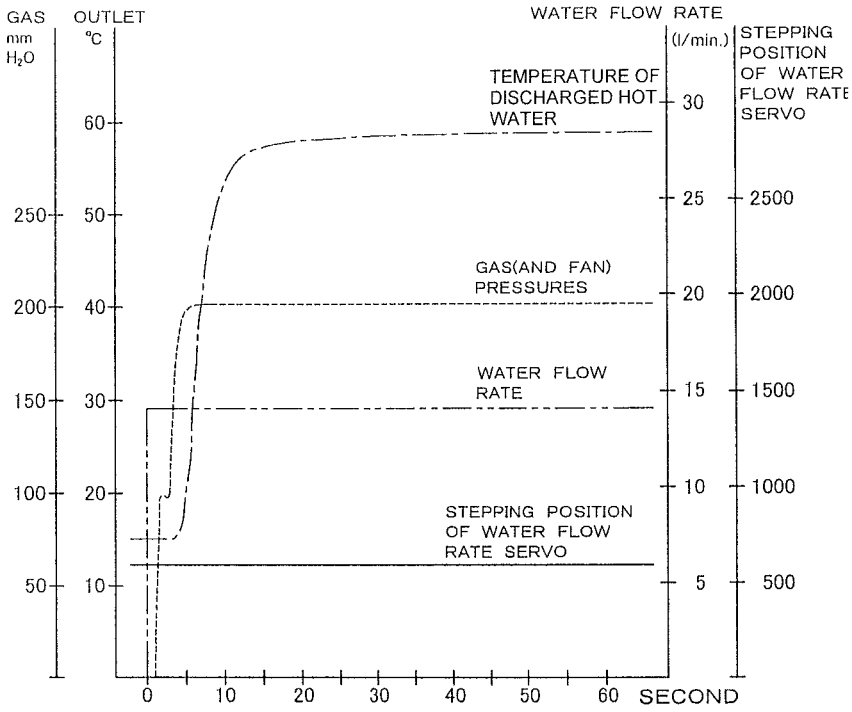
FIG. 5 is a graph illustrating changes of a position of the water flow rate servo and a flow rate of flowing water at the time of starting of an operation in a conventional water heater at a preset temperature of 60° C.

As is clear, in the conventional ignition control of FIG. 5, since the stepping position of the water flow rate servo is fixed, it takes a long time until a temperature of discharged hot water reaches 60° C. (about 20 seconds after opening the valve) by passing of water with the determined water flow rate (about 15 l/min.) from the beginning. Thus, the amount of water and gas used during this process increases.

However, in the aforementioned embodiment, since the water flow rate servo 18 is brought to a position having a reduced water flow rate of flowing water immediately after starting the operation, the amount of flowing water at the beginning is reduced and the temperature of discharged hot water reaches the vicinity of the preset temperature in 10 to several seconds after the opening of the faucet in both cases. Further, although the gas pressure increases for only several seconds from the beginning, it immediately decreases under a control according to the flow rate of flowing water. Then, the gas pressure increases corresponding to an increase of the flow rate of flowing water and reaches a determined pressure substantially at the same time as the flow rate of flowing water reaching the determined flow rate of flowing water. Therefore, the temperature of discharged hot water reaches the preset temperature in a short time and a consumed amount of water and gas is reduced.

Accordingly, according to the water heater 1 of the aforementioned embodiment, the controller 12 compares a detected temperature acquired by the thermistor 21 at a time of starting of the operation with a preset temperature. If the detected temperature is lower than the preset temperature by a predetermined degree, the controller 12 makes the water flow rate servo 18 have a flow rate of flowing water reduced to less than a determined flow rate of flowing water, and performs a temperature control of discharged hot water. Thus, even in the case of the cold start, the time required to reach the preset temperature can be shortened, thereby resulting in saving water and gas.

Particularly, when the temperature of discharged hot water approximately agrees with the preset temperature (a temperature difference is within ±3° C.), the controller 12 sets back the flow rate of flowing water of the water flow rate servo 18 to the determined flow rate of flowing water. Thus, the temperature control of normal discharged hot water can be performed with a sufficient amount of flowing water.

Figure 6:
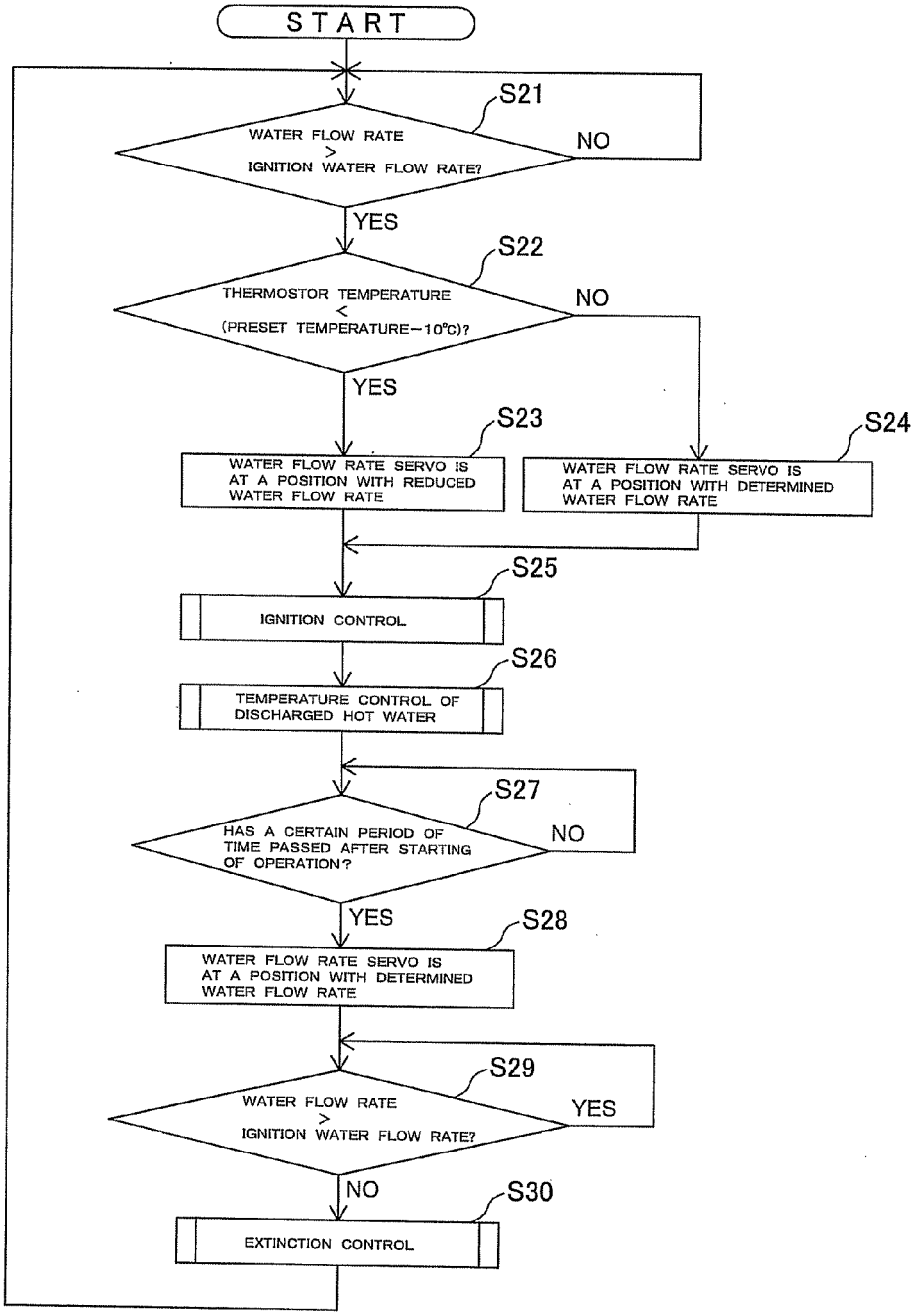
FIG. 6 is a flowchart of a changed example of the operation control of the water heater.

Additionally, in the aforementioned embodiment, the controller 12 determines both whether the first operation was made after the power source being switched on and if not whether 5 minutes has lapsed after the finishing of the last operation, at a time of starting of the operation. However, as shown in FIG. 6, the both determinations can be omitted, so that the controller 12 monitors only a difference between the detected temperature and the preset temperature at a time of starting of the operation in S22, and reduces the water flow by the water flow rate servo in S23 if the temperature difference is 10° C. or more. Of course, the temperature difference to be monitored is not limited to 10° C.

Similarly, a difference between the temperature of discharged hot water after the discharged hot water temperature is controlled and the preset temperature is not limited to a range within ±3° C., and can be properly increased or decreased. Further, instead of monitoring a difference between the temperature of discharged hot water and the preset temperature, the controller 12 can determine whether a certain period of time (e.g., 10 to 20 seconds) has passed after the beginning of the operation as in S27 in FIG. 6, and can set back the water flow rate servo to the position having the determined flow rate of flowing water after confirming the elapsed time (S28). In this case also, the temperature control of discharged hot water can be normally performed with a sufficient flow rate of flowing water.

Furthermore, the configuration of the water heater is not limited to that of the aforementioned embodiment. Of course, the number of burner can be increased or decreased. The present invention can be applied to any types of water heater as long as the device is equipped with a water flow rate control unit such as the water flow rate servo, e.g., a water heater not having a bypass pipe, a water heater having a heat exchanger for bath and a bathtub side circuit capable of filling hot water or additional heating of water, and a water heater having a heat exchanger for recovering a latent heat.

What is claimed is:

1. A water heater comprising:

a burner connected with a gas supplying pipe;

a heat exchanger connected with a water supplying pipe and a hot-water discharging pipe and heated by the burner;

a water flow rate control unit provided at the water supplying pipe and controlling a flow rate of flowing water in the heat exchanger;

a temperature detection unit for detecting water temperature in the hot-water discharging pipe;

a gas pressure control unit provided in the gas supplying pipe to control a flow rate of gas supplied to the burner; and an operation control unit controlling a temperature of discharged hot water so that a detected temperature acquired by the temperature detection unit agrees with a preset temperature by control of combustion of the burner and an operation of the water flow rate control unit, wherein:

the operation control unit compares the detected temperature with the preset temperature and when the detected temperature is lower than the preset temperature by a predetermined degree, the water flow rate control unit immediately reduces the flow rate of the flowing water from a previously determined flow rate of flowing water at a point of time that discharged hot water is required and then the gas pressure control unit immediately reduces the flow rate of gas according to the flow rate of flowing water; and the operation control unit performs the temperature control of the discharged hot water.

2. The water heater according to claim 1, wherein the operation control unit sets back the flow rate of flowing water of the water flow rate control unit to the determined flow rate when the detected temperature approximately agrees with the preset temperature in the temperature control of discharged hot water.

3. The water heater according to claim 1, wherein the operation control unit sets back the flow rate of flowing water of the water flow rate control unit to the determined flow rate when a predetermined period of time elapses after the point of time that discharged hot water is required.

4. The water heater according to claim 1, wherein the operation control unit compares the detected temperatures with the preset temperature immediately at the point of time that discharged hot water is required.

* * * * *